United States Patent [19]

McGarry et al.

[11] 4,347,126

[45] Aug. 31, 1982

[54] APPARATUS AND METHOD FOR FLOTATION SEPARATION UTILIZING A SPRAY NOZZLE

[75] Inventors: Phillip E. McGarry, Palmerton; David E. Herman, Jim Thorpe, both of Pa.

[73] Assignee: Gulf & Western Manufacturing Company, New York, N.Y.

[21] Appl. No.: 230,058

[22] Filed: Jan. 29, 1981

[51] Int. Cl.[3] ..... B03D 1/02; B03D 1/14

[52] U.S. Cl. ..... 209/164; 209/168; 210/706; 210/221.2

[58] Field of Search ..... 209/164, 165, 168, 170; 210/221.2, 703, 706, 707, 205, 209

[56] References Cited

U.S. PATENT DOCUMENTS

| | | | |
|---|---|---|---|
| 2,416,066 | 2/1947 | Phelps | 209/168 |
| 3,326,373 | 6/1967 | Lang | 209/170 X |
| 3,400,818 | 9/1968 | Tartan | 209/170 |

FOREIGN PATENT DOCUMENTS

| | | | |
|---|---|---|---|
| 74582 | 2/1949 | Norway | 209/170 |

OTHER PUBLICATIONS

Perry, Ed., Chemical Engineers Handbook, McGraw-Hill, NY, NY., 1963, pp. 18-63, 18-68.

Dwg. No. 7120, Spraying Systems Co., Wheaton, Il., 12/1973.

Bull. No. KSB 123-7909, Komline-Sanderson, Peapack, NJ, 9/1979.

*Primary Examiner*—Ralph J. Hill

*Attorney, Agent, or Firm*—Scully, Scott, Murphy and Presser

[57] ABSTRACT

An improved method and apparatus for froth flotation separation of the components of a slurry, having particular utility for the beneficiation of coal by the flotation separation of coal particles from impurities associated therewith such as ash and sulfur. In this arrangement, a spray nozzle is positioned above a flotation tank having a water bath therein, and sprays an input slurry through an aeration zone into the surface of the water. The spraying operation creates a froth on the water surface in which a substantial quantity of particulate matter is floating, while other components of the slurry sink into the water bath. A skimming arrangement skims the froth from the water surface as a cleaned or beneficiated product.

25 Claims, 3 Drawing Figures

APPARATUS AND METHOD FOR FLOTATION SEPARATION UTILIZING A SPRAY NOZZLE

BACKGROUND OF THE INVENTION

1. Field of the Invention

The present invention relates generally to a method and apparatus for flotation separation and more particularly pertains to an improved method and apparatus for beneficiating coal by flotation separation of a froth utilizing a spray nozzle such that ground coal particles may be separated from impurities associated therewith such as ash and sulfur.

Coal is an extremely valuable natural resource in the United States because of its relative abundant supplies in this nation. It has been estimated that the United States has more energy available in the form of coal than in the combined natural resources of petroleum, natural gas, oil shale, and tar sands. Recent energy shortages, together with the availability of abundant coal reserves and the continuing uncertainties regarding the availability of crude oil, have made it imperative that methods for converting coal into a more useful energy source be developed.

2. Discussion of the Prior Art

Known prior art processes for froth flotation separation of a slurry of particulate matter are based on constructions wherein air is introduced into the liquid slurry of the particulate matter as, e.g. through a porous cell bottom or a hollow impeller shaft, thereby producing a surface froth. These prior art methods are relatively inefficient approaches especially when large concentrations of particulate matter are being processed. Generally, these techniques are inefficient in providing sufficient contact area between the particulate matter and frothing air. As a result large amounts of energy can be expended in frothing. In addition, froth flotation techniques which permit bubbles to rise in the slurry can tend to trap and carry impurities, such as ash in the froth slurry, and accordingly the resultant beneficiated particulate product can have more impurities therein than necessary.

Methods have been suggested and are being explored in the beneficiation of coal, i.e., the cleaning of coal of impurities such as ash and sulfur, either prior to burning the coal or after its combustion. In one recently developed technique for beneficiation, termed herein chemical surface treating, raw coal is pulverized to a fine mesh size and is then chemically treated. According to this technique the treated coal is then separated from ash and sulfur, and a beneficiated or cleaned coal product is recovered therefrom.

In further detail, in the heretofore mentioned chemical surface treating process coal is first cleaned of rock and the like, and is then pulverized to a fine size of about 48 to 300 mesh. The extended surfaces of the ground coal particles are then rendered hydrophobic and oleophilic by a polymerization reaction. The sulfur and mineral ash impurities present in the coal remain hydrophilic and are separated from the treated coal product in a water washing step. This step utilizes oil and water separation techniques, and the coal particles made hydrophobic can float in recovery on a water phase which contains hydrophilic impurities.

SUMMARY OF THE INVENTION

Accordingly, it is a primary object of the present invention to provide an improved method and apparatus for froth flotation separation of a slurry of particulate matter. In greater particularity, it is a more detailed object of the present invention to provide an improved method and apparatus for beneficiating coal by a froth flotation separation of ground coal particles from impurities associated therewith such as ash and sulfur.

A further object of the subject invention is the provision of an improved method and apparatus for producing aeration in a flotation tank to generate a froth of particulate material such as carbonaceous particles, noncarbonaceous particles, or mixtures of both, coal particles, mine tailings, oil shale, residuals, waste particulates, mineral dressings, graphite, mineral ores, fines, etc.

Another object of the present invention is to provide a method and apparatus for froth flotation separation which is more efficient and results in a cleaner product than prior art operations.

The foregoing objects are accomplished herein by a process which sprays the slurry through an aeration zone in which substantial quanties of air are sorbed by the sprayed fine droplets of the slurry. Accordingly, air is introduced into the froth in a manner which is quite different from prior art approaches. The advantages of this manner of froth generation make the teachings herein particularly applicable to froth flotation separation of slurries which have a substantial proportion of particulate matter therein.

In accordance with the teachings herein, the present invention provides an improved method and apparatus for froth flotation separation of the components of a slurry having particulate matter therein which is to be separated. In this arrangement, at least one spray nozzle is positioned above a flotation tank having a liquid bath therein, and sprays an input slurry containing particulate matter through an aeration zone into the surface of the liquid. The spraying operation creates a froth on the surface of the liquid in which a quantity of the particulate matter is floating, such that the froth containing the particulate matter can be removed from the water surface as a separated product.

In accordance with further details of the present invention, the spray nozzle is preferably a hollow jet cone nozzle defining an approximately 30° spray pattern. Further, the slurry is preferably supplied to the nozzle in a pressure range of from 5 to 40 psi, and more preferably in the range of from 15 to 20 psi. Also, the present invention has particular utility to a coal beneficiation operation for froth flotation separation of a slurry of coal particles and associated impurities.

The present invention operates in a manner which is more efficient than prior art arrangements because of the unique manner of froth generation in which the slurry is sprayed through an aeration zone.

In accordance with further details of another embodiment of the present invention, a skimmer arrangement having a plurality of spaced skimmer plates depending from a conveyor is arranged along the top of the tank to skim the resultant froth therefrom. An upwardly inclined surface extends from the water surface in the tank to a collection tank arranged at one side of the flotation tank, and the skimmer plates skim the froth from the water surface up the inclined surface and into the collection tank.

While the froth flotation system of the present invention is described in detail herein is the context of a coal beneficiating operation, it is apparent that the teachings herein have direct applicability to other applications of froth flotation separation technology. For instance, the froth flotation separation techniques disclosed herein can be utilized in conjunction with particulate matter such as carbonaceous particles, noncarbonaceous particles, or mixtures of both, mine tailings, oil shale, residuals, waste particulates; mineral dressings, graphite, mineral ores, fines, etc.

BRIEF DESCRIPTION OF THE DRAWINGS

The foregoing objects and advantages of the present invention for an arrangement for froth flotation separation may be more readily understood by one skilled in the art with reference being had to the following detailed description of several preferred embodiments thereof, taken in conjunction with the accompanying drawings wherein like elements are designated by identical reference numerals throughout the several drawings, and in which.

DETAILED DESCRIPTION OF THE PRESENT INVENTION

The apparatus and method of the present invention is adapted to the separation of a wide variety of solid-fluid streams by the creation of a solids containing froth phase, and is suitable for the separation of many types of particulate matter. U.S. patent applications Ser. Nos. 114,357 and 114,414, both filed on Jan. 22, 1980, and U.S. patent application Ser. No. 230,056, filed concurrently herewith, are incorporated herein by reference, and may be referred to for further details on the chemical processes which are particularly useful in conjunction with the subject invention.

Figure 1:
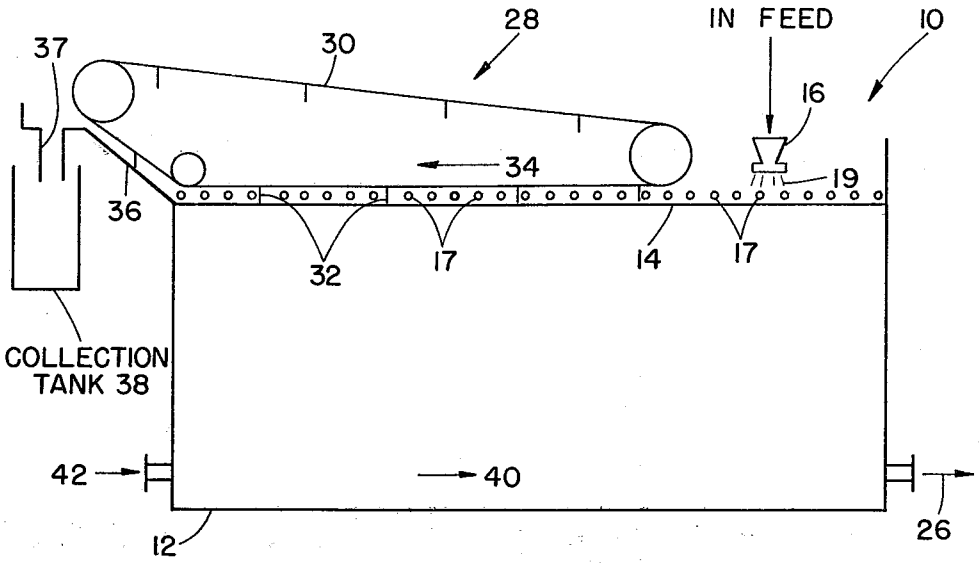
FIG. 1 is an elevational view of a schematic exemplary embodiment of a flotation arrangement constructed pursuant to the teachings of the present invention.

The present invention is described herein with reference to a coal beneficiating operation as disclosed in detail in the aforementioned patent applications. Thus, referring to the drawings in greater detail, FIG. 1 illustrates a first embodiment 10 of the present invention having a flotation tank 12 filled with water to level 14. In operation a slurry of finely ground coal particles, associated impurities, and if desired additional additives such as monomeric chemical initiators, chemical catalysts and fluid hydrocarbons is sprayed through at least one spray nozzle 16 positioned at a spaced apart distance above the water level in tank 12. In alternative embodiments, two or more nozzles can be used to spray slurry and/or any other desired ingredients into the tank.

The stream of treated coal is pumped under pressure through a manifold to the spray nozzle 16 wherein the resultant shearing forces spray the coal flocculent slurry as fine droplets such that they are forcefully jetted into the mass of a continuous water bath in tank 12 to form a froth 17. High shearing forces are created in nozzle 16, and the dispersed particles forcefully enter the surface of the water and break up the coal-oil-water flocs thereby water-wetting and releasing ash from the interstices between the coal flocs and breaking up the coal flocs so that exposed ash surfaces introduced into the water are separated from the floating coal particles and sink into the water bath. The surfaces of the finely divided coal particles now contain air sorbed in the atomized particles, much of which is entrapped by spraying the slurry through an aeration zone 19 such that air is sorbed in the sprayed slurry. The combined effects on the treated coal cause the flocculated coal to decrease in apparent density and to float as a froth 17 on the surface of the water bath. The hydrophilic ash remains in the bulk water phase, and tends to settle downwardly in tank 12 under the influence of gravity. Tank 12 in FIGS. 1 and 3 may be a conventional froth flotation tank commercially available from KOM-LINE-Sanderson Engineering Co., Peapack, N.Y. modified as set forth below. The flotation tank can also include somewhat standard equipment which is not illustrated in the drawings such as a liquid level sensor and control system and a temperature sensing and control system.

The present invention operates on a froth generation principle in which the slurry is sprayed through an aeration zone such that substantial quantities of air are sorbed by the sprayed fine droplets of the slurry. Accordingly, air is introduced into the slurry in a unique manner to generate the resultant froth. The advantages of this manner of froth generation make the teachings herein particularly applicable to froth flotation separation of slurries which have a substantial proportion of particulate matter therein.

The coal particles in the floating froth created by nozzle 16 can be removed from the water surface by, e.g., a skimming arrangement 28 in which an endless conveyor belt 30 carries a plurality of spaced skimmer plates 32 depending therefrom. The skimmer plates are pivotally attached to the conveyor belt to pivot in two directions relative to the belt, and the bottom run of the belt is positioned above and parallel to the water surface in the tank. The plates 32 skim the resultant froth on the water surface in a first direction 34 toward a surface 36, preferably upwardly inclined, extending from the water surface to a collection tank 38 arranged at one side of the flotation tank, such that the skimmer plates 32 skim the froth from the water surface up the surface 36 and into the collection tank 38.

In the arrangement of the disclosed embodiment, the waste disposal at the bottom of the tank operates in a direction 40 flowing from an influent stream 42 to the effluent stream 26, while the skimmer arrangement at the top of the tank operates in direction 34 counter to that of the waste disposal arrangement. Although the illustrated embodiment shows a counterflow arrangement, alternative embodiments are contemplated within the scope of the present invention having, e.g., cross and concurrent flows therein.

Figure 2:
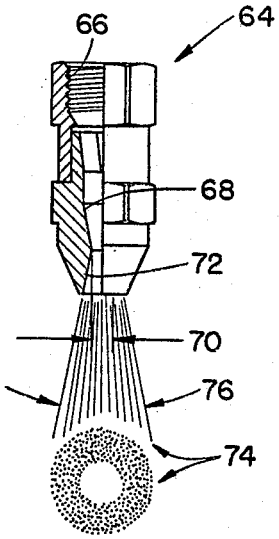
FIG. 2 is a partially sectional elevational view of one type of spray nozzle which can be utilized in the embodiments of FIGS. 1 and 3.

FIG. 2 is a partially sectional view of one type of commercially available spray nozzle 64 which may be used in conjunction with the systems shown in FIG. 1. A recessed threaded coupling 66 is provided to attach the nozzle to a primary or recycle manifold supplying the nozzle with slurry under pressure. The slurry encounters a frustoconical venturi section 68 which accelerates the flow velocity thereof according to the well known venturi effect. The slurry then flows through the nozzle aperture having a nominal diameter 70, which in combination with a diverging section 72 defines a hollow cone spray pattern 74 having an encompassing spray angle 76. In one preferred embodiment of the present invention, angle 76 is approximately thirty degrees, although other angles which provide the herein contemplated results are included within the scope of this invention.

Spray nozzle 64 may be a hollow jet nozzle as is commercially available from Spraying Systems Co., Wheaton, Illinois. Of course, it is contemplated herein that other types of nozzles, which function to provide the desired results as hereinbefore described, may also be used. The nozzles are preferably constructed of stainless steel, ceramic or other suitable hard metal to avoid erosion by the various particles in the slurry being pumped therethrough. The nozzles are preferably supplied with slurry in the supply manifolds at a pressure in the range of 5 to 40 psi, and more preferably in a pressure range of 15 to 20 psi.

Each nozzle 16 may be tilted at an angle with respect to a vertical, (i.e., the position of the nozzle relative to the liquid surface level), such that it functions to direct the flow of froth in a direction towards the skimmer arrangement 28. However, the angle of incidence does not appear to be critical, and the vertical positioning shown in FIG. 1 may be preferred to create a condition most conducive to agitation and froth generation at the water surface. It appears to be significant that the agitation created by the nozzle sprays define a zone of turbulence extending a limited distance beneath the water surface level. Too much turbulence may actually reduce the amount of frothing produced at the water surface. Among other means, the depth of the turbulence zone may be adjusted by varying the supply pressure of the slurry in the supply manifolds and also the distance of the nozzles above the water surface. In one operative embodiment, a zone of turbulence extending two to four inches beneath the water surface produce very good agitation and froth generation, although the distance is dependent on many variables such as the tank size, the medium in the tank, etc. and accordingly may vary considerably in other embodiments.

Figure 3:
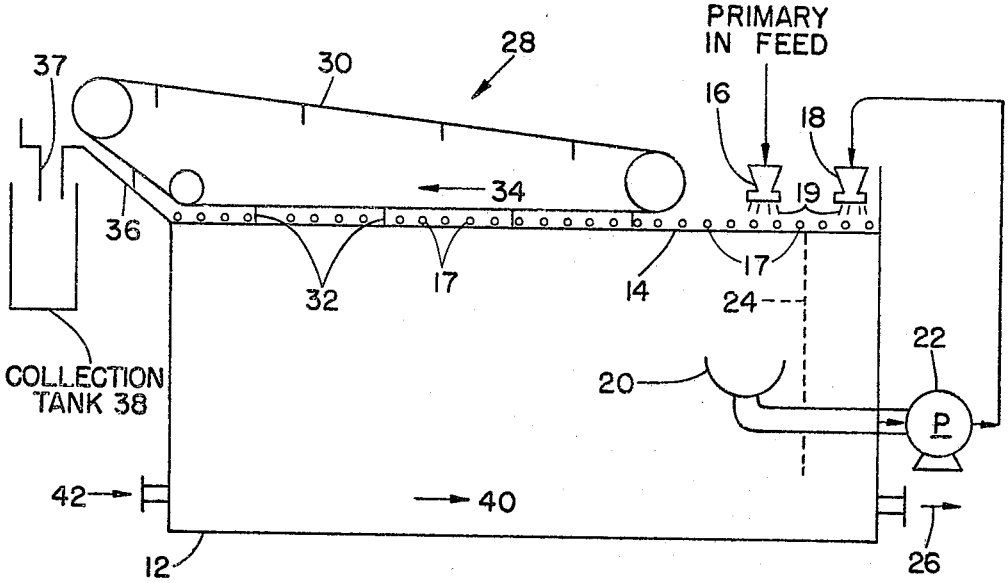
FIG. 3 illustrates an elevational view of one flotation tank utilizing the invention herein.

In one operation utilizing the present invention, as shown in FIG. 3, a recycling technique is employed to further improve the efficiency relative to prior art arrangements. In the recycling technique, coal particles which do not float after being sprayed through a spray nozzle 16, designated a primary spray nozzle in context with this embodiment, are recycled to a further recycle spray nozzle 18 to provide the coal particles a second opportunity for recovery. In this arrangement a collector trough 20, preferably in the form of an open hemispherical pipe, is positioned in tank 12 beneath the primary spray nozzle(s) 16 for collecting the sinking materials. A pump 22 is coupled to trough 20 and functions to draw settling materials into the trough from which it is pumped under pressure to the recycle spray nozzle(s). At least one recycle spray nozzle 18, which may be the same type of nozzle as primary spray nozzle 16, is provided above the tank for respraying into the surface of the water bath the materials collected by the trough such that coal particles collected therein are recycled and a portion of the recycled coal floats as a froth on the water surface an additional time and is recovered. The recycled spray nozzle(s) 18 is positioned in proximity to the primary spray nozzle(s) 16, and a vertical baffle plate 24 is positioned to provide separation for materials sinking from the sprays of the respective nozzles. In alternative embodiments further stages of recycling may be provided by adding additional troughs and recycle nozzles in the tank.

This arrangement results in an efficient operation, providing more effective cleaning of the coal and higher product recoveries by providing that coal particles which do not initially float have a high probability of being resprayed onto the water surface to promote secondary recovery of the product from waste materials.

After the recycling operation, the materials which sink from the recycle spray tend to settle downwardly in tank 12 under the influence of gravity, and are withdrawn in an ash-water stream 26 from the base of the vessel.

This recycling technique employing the baffle and trough are disclosed and claimed in U.S. application Ser. No. 230,059 filed concurrently herewith and incorporated by reference herein.

While several embodiments and variations of a method and apparatus for froth flotation separation of the components of a slurry have been described in detail herein, it should be apparent that the teachings and disclosure of the present patent will suggest many other embodiments and variations to those skilled in this art.

What is claimed is:

1. Apparatus for froth flotation separation of the components of a slurry having particulate matter therein, said apparatus comprising:

a. a flotation tank;

b. at least one spray nozzle adapted to cause a diverging spray, said spary nozzle positioned above said flotation tank and further adapted to spray under pressure an input slurry containing said particulate matter so that said particulate matter is dispersed through an aeration zone of increasing cross sectional area into the surface of a liquid in said tank to create a froth phase on the surface in which a quantity of the particulate matter is floating; and c. means for controlling the agitation created by said at least one spray nozzle to provide a zone of turbulence extending a limited distance beneath the surface of a liquid in said tank.

2. Apparatus for froth flotation separation of the components of a slurry as claimed in claim 1, wherein said at least one spray nozzle is positioned at a spaced apart distance from said surface of a liquid in said tank.

3. Apparatus for froth flotation separation of the components of a slurry as claimed in claim 1, wherein said at least one spray nozzle includes a hollow jet nozzle spraying a hollow cone pattern into the liquid surface of the tank.

4. Apparatus for froth flotation separation of the components of a slurry as claimed in claim 3, said hollow jet nozzle including about a 30° hollow cone spray nozzle.

5. Apparatus for froth flotation separation of the components of a slurry as claimed in claim 1, including means for supplying said at least one spray nozzle with slurry under pressure in a range of from 5 to 40 psi.

6. Apparatus for froth flotation separation of the components of a slurry as claimed in claim 5, said means supplying said at least one spray nozzle with slurry under pressure in a pressure range of from 15 to 20 psi.

7. Apparatus for froth flotation separation of the components of a slurry as claimed in claim 1, including means for supplying said spray nozzle with a slurry of coal particles, associated impurities, and surface treating chemicals for the coal particles and means for skimming froth accumulated on said surface of a liquid in said tank, whereby the apparatus is utilized for the beneficiation of coal.

8. A method for froth flotation separation of the components of a slurry having particulate matter therein, said method comprising the steps of:

a. spraying under pressure an input slurry having particulate matter therein through at least one spray nozzle adapted to cause a diverging spray so that said particulate matter is dispersed through an aeration zone into a liquid surface to create a froth on the surface in which a quantity of the particulate matter is floating;

b. controlling the agitation created by said at least one spary nozzle to provide a zone of turbulence extending a limited distance beneath said liquid surface; and c. removing the froth from the liquid surface.

9. A method for froth flotation separation of the components of a slurry as claimed in claim 8, said step of spraying including the step of spraying through at least one hollow jet nozzle to produce a hollow cone spray pattern.

10. A method for froth flotation separation of the components of a slurry as claimed in claim 9, said step of spraying including the step of spraying through at least one 30° hollow cone spray nozzle to produce a 30° hollow cone spray pattern.

11. A method for froth flotation separation of the components of a slurry as claimed in claim 8, further including the step of supplying slurry to the spray nozzle with a pressure in the range of from 5 to 40 psi.

12. A method for froth flotation separation of the components of a slurry as claimed in claim 11, said step of supplying slurry including supplying slurry with a pressure in the range of from 15 to 20 psi.

13. A method for froth flotation separation of the components of a slurry as claimed in claim 8, further comprising the step of supplying the spray nozzle with a slurry of coal particles, associated impurities, and surface treating chemicals for the coal particles, whereby the process is utilized for the beneficiation of coal.

14. An apparatus for froth flotation separation of the components of a slurry having particulate matter therein, said apparatus comprising:

a. a flotation tank;

b. at least one spray nozzle for spraying an input slurry under pressure through an aeration zone, said at least one spray nozzle being adapted to spray a bulk of said slurry as fine droplets through said aeration zone which fine droplets are projected through said aeration zone and into the surface of a liquid in said flotation tank to form a froth on the surface of said liquid in which a quantity of said particulate matter floats; and c. means for controlling the agitation created by said at least one spray nozzle to provide a zone of turbulence extending a limited distance beneath the surface of a liquid in said tank.

15. An apparatus as defined in claim 14 wherein said at least one spray nozzle has a diverging outlet section.

16. An apparatus as defined in claim 14 wherein said at least one spray nozle includes a hollow jet nozzle spraying a hollow cone pattern into a liquid surface of the tank.

17. An apparatus as defined in claim 14 wherein said at least one spray nozzle has a frustoconical venturi section.

18. An apparatus as defined in claim 14 further comprising means for supplying said at least one spray nozzle with slurry under pressure in a pressure range of from 5 to 40 psi.

19. A method for froth flotation separation of the components of a slurry having particulate matter therein, said method comprising the steps of:

a. introducing an input slurry under pressure through at least one spray nozzle for spraying said input slurry through an aeration zone so that a bulk of said input slurry is divided into fine droplets, which fine droplets are projected through said aeration zone and into the surface of a liquid in said flotation tank to form a froth phase on the surface of said liquid in which a quantity of the particulate matter floats;

b. controlling the agitation created by said at least one spray nozzle to provide a zone of turbulence extending a limited distance beneath the surface of said liquid surface; and c. removing the froth from the liquid surface.

20. A method as defined in claim 19 wherein said input slurry sprayed in step (a) is divided into atomized particles which sorb air in said aeration zone thereby decreasing the apparent density of said atomized particles.

21. A method as defined in claim 19 wherein said at least one spary nozzle has a frustoconical venturi section.

22. A method as defined in claim 19 further comprising the step of spraying said input slurry through at least one hollow cone spray nozzle to produce a 30 degree hollow cone spray pattern.

23. A method as defined in claim 19 wherein said input slurry is supplied in a pressure range of from 5 to 40 psi.

24. A method as defined in claim 19 further comprising the step of supplying said at least one spray nozzle with an input slurry comprising a slurry of coal particles, whereby the method is utilized for the beneficiation of coal.

25. A method as defined in claim 19 further comprising the step of supplying said at least one spray nozzle with a slurry of coal particles, associated impurities and surface treating chemicals for the coal particles, whereby the process is utilized for the beneficiation of coal.

* * * * *

UNITED STATES PATENT AND TRADEMARK OFFICE

CERTIFICATE OF CORRECTION

PATENT NO. : 4,347,126

DATED : August 31, 1982

INVENTOR(S) : Phillip E. McGarry et al.

It is certified that error appears in the above-identified patent and that said Letters Patent are hereby corrected as shown below:

Column 2, Line 22 "quanties" should read --quantities--;

Column 6, Line 27 "spary" should read --spray--;

Column 7, Line 12 "spary" should read --spray--;

Column 8, Line 4 "nozle" should read --nozzle--; and

Column 8, Line 37 "spary" should read --spray--.

Signed and Sealed this

*Fourth* Day of *January 1983*

[SEAL]

*Attest:*

GERALD J. MOSSINGHOFF

*Attesting Officer*

*Commissioner of Patents and Trademarks*